US006025549A

United States Patent [19]

Harris

[11] Patent Number: 6,025,549

[45] Date of Patent: Feb. 15, 2000

[54] DRUM COVER

[76] Inventor: J. Vincent Harris, 3636 Taliuna Ave., Knoxville, Tenn. 37919

[21] Appl. No.: 09/070,309

[22] Filed: Apr. 30, 1998

[51] Int. Cl.[7] ..... G10D 13/02

[52] U.S. Cl. ..... 84/411 R; 84/453

[58] Field of Search ..... 84/411 R, 453, 84/412, 418, 419, 420; 150/162; 383/86, 22; 206/314; 224/910, 901.8

[56] References Cited

U.S. PATENT DOCUMENTS

| | | | |
|---|---|---|---|
| 306,731 | 10/1884 | Fairbanks | 206/314 |
| 312,804 | 2/1885 | Brown | 206/314 |
| 1,084,719 | 1/1914 | Wanamaker | 150/162 |
| 1,321,029 | 11/1919 | Goldberg | 206/314 |
| 2,563,933 | 8/1951 | Hipps et al. | 383/86 |
| 5,772,091 | 6/1998 | Lackner | 224/265 |

*Primary Examiner*—Robert E. Nappi
*Assistant Examiner*—Shib-yung Hsieh
*Attorney, Agent, or Firm*—Luedeka, Neely & Graham PC.

[57] ABSTRACT

The present invention relates to a drum cover which protects a drum from inclement weather while not significantly reducing the ability to play or the performance of the drum. The drum cover is made out of weather resistant materials which are shaped to cover the drum striking area and drum shell. The drum cover can be configured to fit a wide variety of drums, including snare drums, bass drums and multiple tenor drum sets such as quad drum sets and quint drum sets. The drum cover is easily placed on the drum and easily removed. In addition, a drum cover carrying case is provided, for storing the drum cover when it is not in use.

10 Claims, 4 Drawing Sheets

DRUM COVER

FIELD OF INVENTION

The invention relates generally to drum covers, and particularly to drum covers for protecting percussion instruments from inclement weather.

BACKGROUND AND SUMMARY OF THE INVENTION

Marching bands are a traditional fixture in many cultural celebrations ranging from Macy's annual Thanksgiving Day Parade, to professional, college and high school football game half-time shows around the country.

Perhaps the best known marching band instruments are the percussion instruments. Most marching bands have at least one large bass drum, pounding out a steady rhythm so that the performers of the band can all march to the same beat. Other drums are standard fixtures in marching bands, including various sizes and shapes of snare drums, and multiple tenor drum sets such as quad drum sets and quint drum sets.

Marching band shows are almost never canceled, performing even in the most inclement weather, including driving rain and snow. Inclement weather is extremely harmful to most marching band instruments. Percussion instruments are especially vulnerable to moisture damage caused by exposure to rain and snow. Percussion instruments are typically made of materials which warp, rot and rust when exposed to damp environments. Consequently, exposure to moist atmospheric conditions can greatly reduce the useful life of a percussion instrument Accordingly, it is an object of the present invention to provide a percussion instrument cover to protect a percussion instrument from inclement weather and to expand the useful life of the percussion instrument.

Another object of the invention is to provide a percussion instrument cover which can be easily and quickly placed on and removed from the instrument as needed.

It is a further object of the invention to provide a percussion instrument cover which does not significantly hinder the performance of a percussion instrument while the instrument is covered.

It is another object of the invention to provide a percussion instrument cover which is light weight and compactable for ease of storage.

Yet a further object of the invention is to provide a percussion instrument cover which can be stored close to the instrument, such that it can be quickly accessed when sudden inclement weather arises.

Yet another object of the invention is to provide a percussion instrument cover which is durable, such that it will not tear when played upon as if it were a normal percussion instrument striking surface.

SUMMARY OF THE INVENTION

These and other needs are met by a drum cover which covers a percussion instrument, protecting it from inclement weather, yet allowing the instrument to be played without significantly hindering the performance of the instrument. The drum cover is selectively configured and dimensioned to cover all sizes and types of drums, for example: snare drums, bass drums, and multiple tenor drum sets such as quad drum sets and quint drum sets.

Many drums, such as snare drums, have a single striking area, where the drum is struck to produce sound. These drums also have a single drum shell, extending downwards from the striking area, which provides support for the striking area and also provides a resonance chamber to amplify the drum sound. In addition, the snare drum has a single peripheral rim extending above the striking area, for providing support to the striking area. The snare drum also contains a harness attachment, so that the snare drum can be carried comfortably while it is being played.

Other drums, such bass drums have two striking areas, parallel to each other, connected by a drum shell. Peripheral rims extend out past the striking areas of the bass drum. Bass drums also have a area where a harness can be attached to the drum.

Some drums are combined into multiple tenor drum sets, such as trio drum sets (three drums of varying pitch, arranged and connected together), quad drum sets (four drums of varying pitch, arranged and connected together), quint drum sets, and six drum sets. These multiple tensor drum sets contain a plurality of striking areas, a plurality of drum shells, a plurality of peripheral rims and at least one harness attachment.

The drum cover is specifically designed to fit the individual drum sizes and shapes. For example a drum cover for a snare drum is comprised of a striking surface which is configured and dimensioned to fit over the snare drum striking area. The snare drum striking surface is substantially circular in shape and is bounded by an outer circumference. "Substantially circular" is intended to have a broad meaning to cover elliptical, oval and deformed oval shapes, each characterized by having a circumferential appearance configured to closely fit over one or more drums. The striking surface covers the striking area of the snare drum, protecting the striking area from inclement weather. The drum cover is also comprised of a drum shell cover, substantially cylindrical in shape, having an upper and lower circular periphery. "Substantially circular" is again intended to have a broad meaning covering deformed cylinders having elliptical, oval or deformed oval cross sectional shapes. An upper circular periphery of the drum shell cover is affixed to the outer circumference of the striking surface by a seam. The drum shell cover extends downwards from the striking surface to encompass the shell of the snare drum, protecting it from rain, snow and other detrimental conditions. First and second flaps are formed by a slit in the drum shell cover. The slit extends from the lower circular periphery towards the upper circular periphery of the drum shell cover, providing an opening for inserting and removing the snare drum from the drum cover. The first and second flaps each have edges. The edges of the flaps can have fasteners so that the first flap can be fastened to the second flap, securing the drum cover around the instrument. Preferably, the lower circular periphery of the drum shell cover contains a hemmed portion. A drawstring is threaded through the hemmed portion, exiting the hemmed portion at the edges of the first and second flaps. The drawstring can be tightened to secure the snare drum cover to the snare drum. In a most preferred embodiment the drawstring is comprised of a piece of elastic material which can be strung through the hemmed portion, so that when the cover is placed over the instrument the elastic material contracts and causes the bottom of the cover to tighten beneath the instrument. Most preferably, an annular shaped piece of stress resistant material is attached to an outer annular portion of the striking surface and upper cylindrical portion of the snare drum shell cover, in order to reinforce the cover adjacent to the peripheral rim of the snare drum. By "annular" it is meant that the stress resistant material has a somewhat donut shape, conforming to the "substantially circular" shape of the striking surface circumference.

When the drum cover is customized to fit a bass drum, modifications must be provided. Bass drums are similar to snare drums in that they have a drum shell and a harness attachment. However, bass drums differ from snare drums because they have two striking surfaces and two peripheral rims. A bass drum cover is comprised of a first and a second striking surface, each having a substantially circular dimension which is bounded by an outer circumference. The first and second striking surfaces are configured and dimensioned to fit over the first and second striking areas of the bass drum, respectively. The first and second striking surfaces cover and protect the striking area of the bass drum.

In addition, a bass drum shell cover is provided, which has a substantially cylindrical shape bounded by first and second circular peripheries. The bass drum shell cover is configured to encompass and cover the bass drum shell. A first seam affixes the first circular periphery to the first striking surface and a second seam affixes the second circular periphery to the second striking surface.

The bass drum cover is preferably further comprised of first and second flaps in the drum shell cover formed by a circumferential slit in the drum shell cover. The flaps have edges. The circumferential slit provides an opening for inserting and removing the drum from the drum cover.

Most preferably, the bass drum cover has fasteners on the edges of the first and second flaps so that the drum cover can be secured around the bass drum by attaching at least a portion of the first flap to at least a portion of the second flap. An opening for the harness attachment is provided in the drum shell cover. In the most preferred embodiment, the bass drum cover can also have a first and a second piece of stress resistant material, annular in shape. The first annular piece of material is positioned to cover an outer annular portion of the first striking surface and first circular periphery. The stress resistant material reinforces the drum cover adjacent the first peripheral rim of the bass drum. Likewise, the second piece of stress resistant material is also substantially annular in shape. It is positioned to cover an outer annular portion of the second striking surface and second circular periphery, for reinforcing the bass drum cover adjacent the second peripheral rim of the bass drum.

When a drum cover is customized to fit multiple tenor drum sets containing more than one drum, features of the drum set must be taken into consideration. For example, consider a drum set that contains a plurality of striking surfaces and a plurality of drum shells and at least one harness attachment. The drum cover striking surface is substantially circular in shape and is bounded by an outer circumference. The striking surface is configured and dimensioned to fit over a plurality of striking surfaces, covering all the striking areas of the drum set. The drum set cover further comprises a drum shell cover, which is substantially cylindrical in shape and conforms to the overall shape of the drum set. It extends downwards from the striking surface to encompass and cover the plurality of drum shells. It contains an upper and lower circumference. A seam affixes the striking surface to the upper circumference of the drum shell cover. The drum set cover is further comprised of first and second flaps formed in the drum shell cover by a slit. The slit extends from the lower circular periphery toward the upper circular periphery, providing an opening for inserting and removing the drum set from the drum cover. The first and second flaps also define edges. The drum set drum cover is preferably further comprised of fasteners on the edges of the first and seconds flaps. A portion of the first flap can be attached to at least a portion of the second flap so that the drum set cover can be secured to the drum set. In addition, the drum set cover is preferably further comprised of a hemmed portion in the lower circular periphery of the drum shell cover. A drawstring is threaded through the hemmed portion, exiting the hemmed portion at the first and second flaps, and tightened for securing the drum shell cover to the drum set. As in the snare drum drum cover, the drawstring is preferably comprised of a piece of elastic material. The drum cover also preferably contains at least one opening, providing access to at least one harness attachment.

The drum shell covers are comprised of a weather resistant material, which is also preferably stress resistant. Examples of materials from which the drum cover can be made include "GORTEX", PVC and ripstop nylon.

Finally, a carrying case is provided for storing the drum cover, conveniently close to the percussion instrument. The cover carrying case is comprised of a bag having a bottom side, and a first and a second side, which are all sealed. A top side of the bag is open, allowing access to an inner pocket. The inner pocket has a volume sufficient to completely hold the drum cover. A bag fastener is also provided for sealing at least a portion of the top side of the carrying case. Finally, the carrying case is comprised of at least one percussion instrument fastener for attaching the carrying case to the drum.

BRIEF DESCRIPTION OF THE DRAWINGS

Further advantages of the invention will become apparent by reference to the detailed description of preferred embodiments when considered in conjunction with the figures, which are not to scale, wherein like reference numbers indicate like elements through the several views, and wherein.

DETAILED DESCRIPTION

Figure 1A:
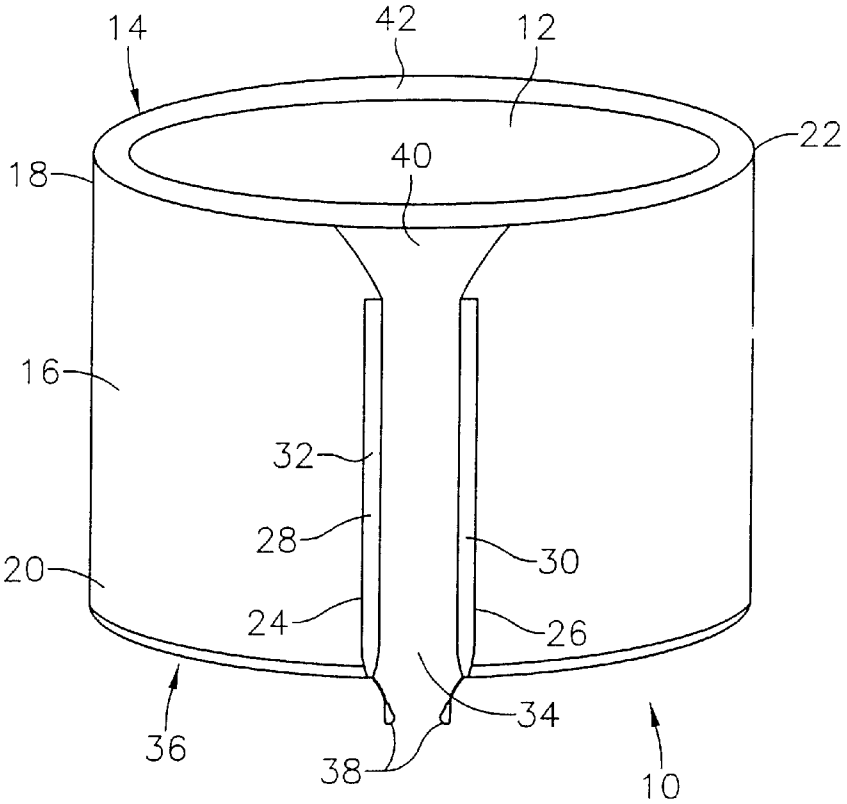
FIGS. 1A and 1B are perspective views of a drum cover for a drum with a single striking surface and a single drum shell.
Figure 1B:
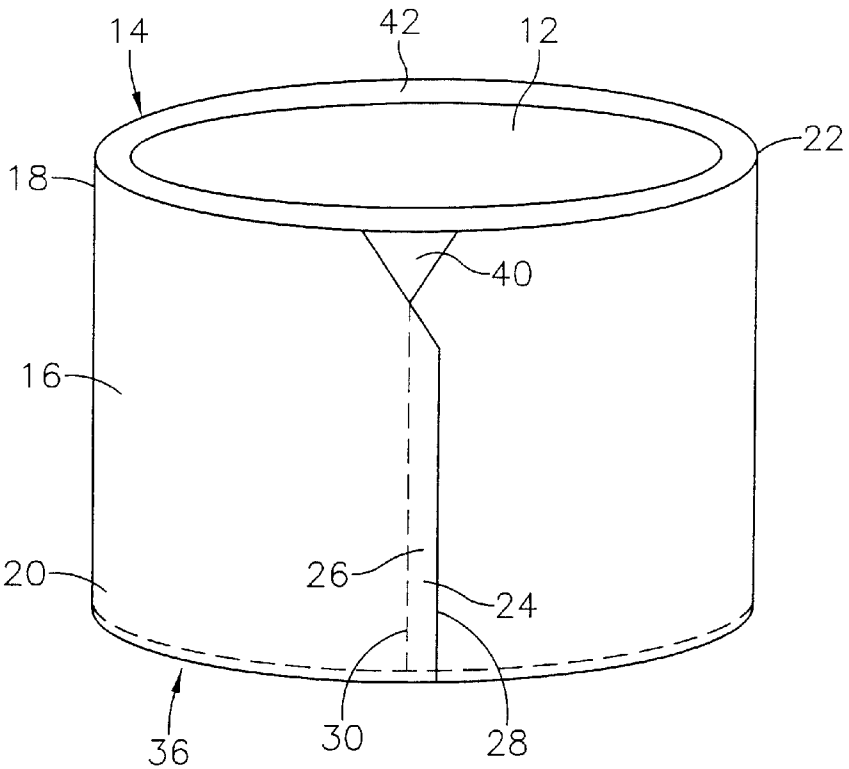

Referring now to FIGS. 1A and 1B, there is depicted a drum cover, for protecting a percussion instrument, such as drum cover 10, for a drum with a single striking area, a single peripheral rim and a single drum shell. The cover 10 has a striking surface 12 with an outer circumference 14, which is shaped to fit over the striking area of a drum head, such as a snare drum. Because drums with single striking areas come in many sizes, the striking surface 12 can be customized to cover the various sizes of striking areas of a drum.

Marching band instruments, especially percussion instruments are vulnerable to inclement conditions. Drums are typically made out of materials which rot, warp and rust when exposed to rain and snow and other wet conditions. Thus, the striking surface is made out of materials which act as a barrier to prevent moisture from reaching the striking surface of the drum, such as "GORTEX" fabrics, PVC and ripstop nylon and other similar materials.

The striking surface 12 is attached to a drum shell cover 16. The drum shell cover 16 is preferably cylindrical in shape. It has an upper circumference 18 and a lower circumference 20. The drum shell cover 16 is attached to the striking surface 12 by a seam 22, located near the upper circumference 18. The drum shell cover 16 extends downwards from the striking surface 12. It is configured to encompass and cover a drum shell. Similar to the striking surface 12, the drum shell cover 16 can be customized to fit various sizes and shapes of single striking area type drums. In addition, the drum shell cover 16 is made out of materials which create a barrier between the drum shell and the outside weather, similar to the materials from which striking surface 12 is made.

The drum shell cover 16 has a first flap 24 and a second flap 26, created by a slit 34. The slit 34 extends from the lower circumference 20 toward the upper circumference 18. The slit 34 creates an opening for inserting the drum into and removing the drum from the drum cover 10.

The flaps 24 and 26 have edges 28 and 30, respectively. The edges 28 and 30 contain fasteners 32. The fasteners 32 can be fastened so that at least a portion of flap 24 is fastened to flap 26. By fastening flaps 24 and 26, the drum cover 10 is secured to the drum, preventing the drum cover 10 from accidentally falling off. In addition, by securing the flaps 24 and 26, the drum is more protected from the weather, reducing the exposure of the drum. The fasteners 32 can be chosen from any type of suitable fasteners including snaps, hoop and loop material, hook and eye fasteners, buttons, zippers and other fasteners known in the art.

The slit 34 is not completely closed by fasteners 32. Towards the upper circumference 18 of the drum shell cover 16, an opening 40 is provided. The opening 40 is positioned to allow access to a harness attachment. By providing an opening 40, the drum can be quickly attached and detached from the harness attachment without removing the drum cover 10 from the drum. This is especially beneficial when the drum must remain outside in inclement weather, between performances. That is, the drummer is able to attach, detach and reattach the drum from the harness attachment without removing the drum cover 10.

In addition, the lower circumference 20 of the drum shell cover 16 contains a hemmed portion 36. A drawstring 38 is threaded through the hemmed portion 36. The drawstring 38 can be tightened to "draw up" the lower circumference 20. When the drum is inserted into the drum cover 10, the drawstring 38 is tightened, further securing the drum cover 10 to the drum. In a preferred embodiment, the drawstring 38 can be comprised of a piece of elastic material. In this embodiment the elastic drawstring 38 is expanded or stretched out as the drum cover 10 is placed over the drum. Once the drum cover 10 is in place, the elastic drawstring 38 is allowed to contract to its resting position, securing the drum cover 10 to the drum.

In a further embodiment, the drum cover 10 can contain an annular portion 42. The annular portion 42 is positioned to cover the outer circumference of the striking surface 12 and the upper circumference 18. The annular portion 42 provides additional reinforcement of the drum cover 10, around the rim of the drum. The annular portion 42 is made out of a stress resistant material. When playing a drum, often times drumsticks will accidentally hit the rim of the drum. This is called a "rim shot." The drumstick strikes the drum with considerable force. When the drumstick accidentally strikes the rim, the drum cover 10 can be dented, pinched or even broken open in a small space. Repeated "rim shots" to the same area can reduce the effectiveness of the drum cover 10, by creating accidental openings through which moisture can seep. By providing an annular portion 42, the vulnerable area of the drum cover 10 around the drum rim is reinforced, increasing the usable life of the drum cover 10.

Figure 2A:
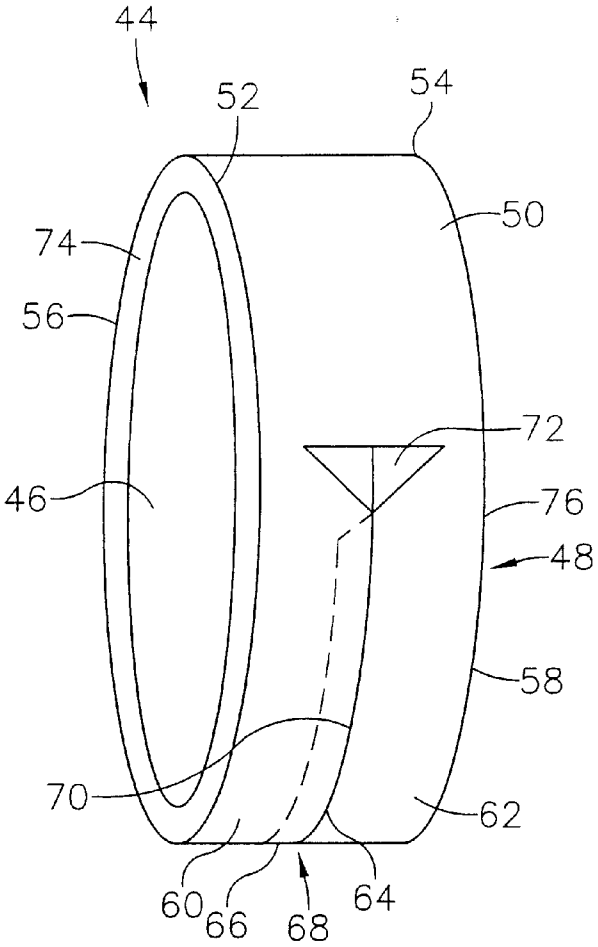
FIGS. 2A and 2B are perspective views of a drum cover for a drum with two striking surfaces and a single drum shell.
Figure 2B:
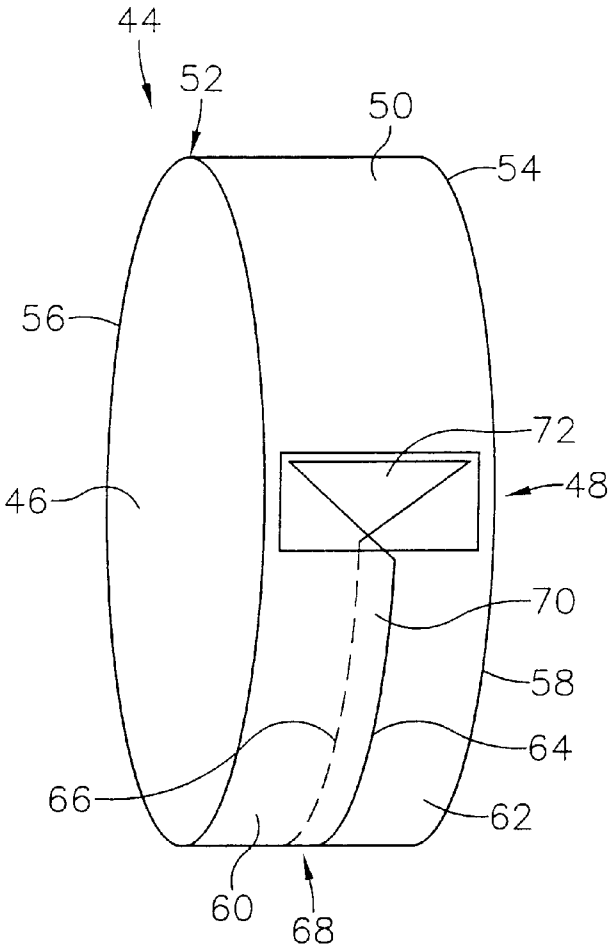

Another embodiment of the invention is shown in FIGS. 2A and 2B. In this drawing, a drum cover 44 is shown. Drum cover 44 is designed to cover a drum with two striking areas. An example of a drum with two striking areas would be a bass drum. Drum cover 44 has a first striking surface 46 and a second striking surface 48. The striking surfaces 46 and 48 are basically circular and are designed to cover the striking areas of a drum, like a bass drum. Because drums with two striking areas come in many sizes and dimensions, the striking surfaces 46 and 48 can be shaped and dimensioned to fit various sizes of striking areas. The striking surfaces 46 and 48 are made of materials which provide a barrier to rain, snow and other wet environmental conditions, as mentioned above. The striking areas 46 and 48 provide a barrier which prevents moisture from reaching the vulnerable striking areas of a drum.

A drum shell cover 50 is provided to cover and protect the drum shell of the drum from moisture. The drum shell cover 50 is basically cylindrical in shape and has a first circular periphery 52 and a second circular periphery 54. Drum shell cover 50 is attached to the first striking surface 46 by a first seam 56 at the first circular periphery 52 and to the second striking surface 48 by a second seam 58 at the second circular periphery 54. Because the size and dimensions of various bass drums vary, the drum shell cover 50 can be of assorted sizes. Like the striking surfaces 46 and 48, the drum shell cover 50 can be made out of any suitable weather resistant material.

The drum shell cover 50 contains a first flap 60 and a second flap 62. The flaps 60 and 62 contain a first edge 64 and a second edge 66, respectively. The flaps are formed by a circumferential slit 68. The circumferential slit 68 provides an opening from which the drum can be inserted into and removed from the drum cover 44. The edges 64 and 66 contain fasteners 70. The fasteners 70 can be of any suitable fastener, as in the previously mentioned fasteners 32. The fasteners 70 allow the flaps 60 and 62 to be fastened to each other, securing the drum cover 44 to the drum. Also, when the flaps 60 and 62 are secured to each other by the fasteners 70, the drum is more protected from the elements, because the opening formed by slit 68 is closed, reducing the drum's exposure to the elements.

When the flaps 60 and 62 are secured to each other by fasteners 70, the slit 68 is not completely closed, providing an opening 72 for a harness attachment. The importance of the opening for the harness attachment has already been discussed in detail in reference to FIG. 1.

In a further embodiment, drum cover 44 can contain a first annular portion 74 attached to the first striking surface 46 area, adjacent the first seam 56, providing extra reinforcement over the first rim of the drum. Likewise a second annular portion 76 can be attached to the second striking surface 48, adjacent the second seam 58, for providing extra coverage over the second rim of the drum. The annular portions 74 and 76 are made out of stress resistant material which can withstand repeated high force hits without ripping, tearing or becoming punctured. As was the case with drum cover 10, "rim shots" can pinch, break or tear the drum cover. By placing extra portions of stress resistant material around the rims of the drum, the effective life of the drum cover can be greatly increased.

Figure 3A:
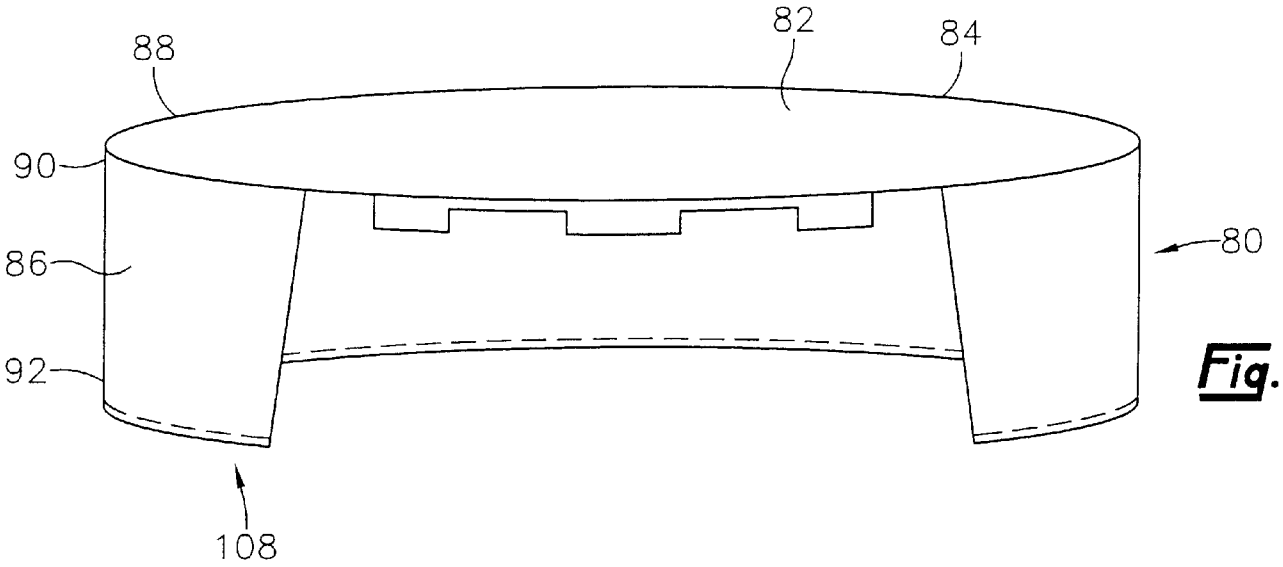
FIGS. 3A and 3B are perspective views of a drum cover for a multiple tenor drum set with a plurality of striking surfaces and a plurality of drum shells.
Figure 3B:
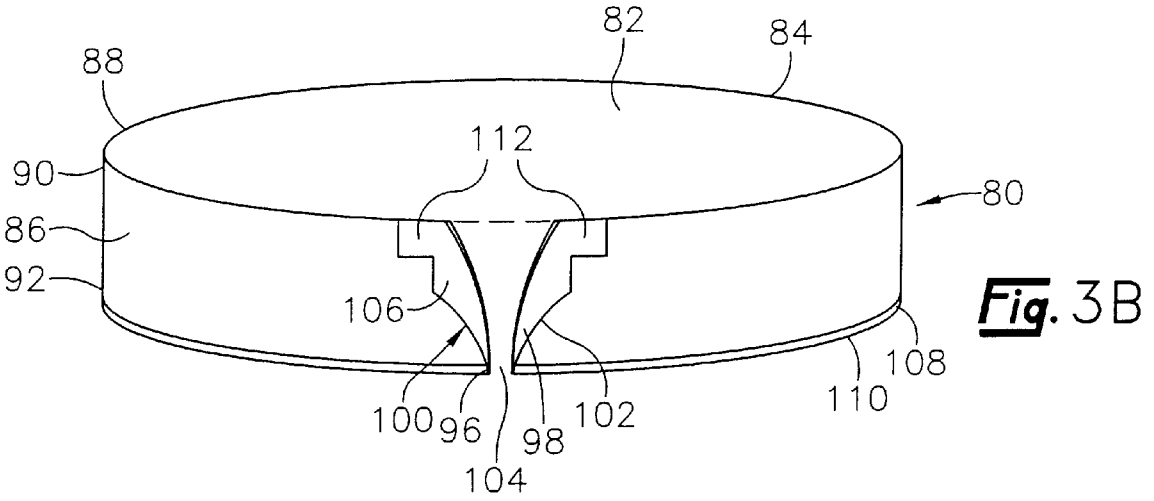

Another embodiment of the invention is seen in FIGS. 3A and 3B. In this example, a drum cover 80 is shown, which covers a multiple tenor set drum with multiple striking areas and multiple drum shells and at least one harness attachment, such as a quint drum set or a quad drum set and other multiple drum sets. In this embodiment a striking surface 82 is provided to cover a plurality of striking areas. The striking surface 82 is basically circular in shape and contains an outer periphery 84. It has a large enough surface area to completely cover all of the striking areas of the drum set. Because drum sets are available in different sizes and because different drum sets contain different numbers of drums, the striking surface 82 can be made into various sizes. Despite the size or number of striking areas in a drum set, the striking surface 82 is designed to completely cover the entire combined striking area of the drum set. The striking surface 82 lays over the striking areas of the drum set and prevents moisture from reaching the striking areas. Again, the striking surface 82 is made out of weather proof materials, as mentioned above.

The striking surface 82 is attached to a drum shell cover 86 at the outer periphery 84. The drum shell cover 86 has an upper circular periphery 90 and a lower circular periphery 92. Seam 88 attaches the drum shell cover 86 to the striking surface 82 at the upper circumference 90. The drum shell cover 86 is basically cylindrical in shape and extends downwards from the striking surface 82. The drum shell cover 86 is designed to encompass and collectively cover all of the drum shells in the drum set. The drum shell cover 86 is made of the same type of materials as the striking surface 82. The drum shell cover protects the drum shells of the drum set from inclement weather, extending the usefull life of the drum set instrument.

The drum shell cover 86 has a first flap 96 and a second flap 98, having first and second edges, 100 and 102 respectively. The flaps 96 and 98 are formed by a slit 104 which extends upwards from the lower circular periphery 92 towards the upper circular periphery 90. The slit 104 creates an opening into which the drum set can be inserted and removed. The edges 100 and 102 have fasteners 106 so that the flaps 96 and 98 can be fastened to each other. As mentioned previously, the fasteners 106 can be snaps, hoop and loop material, hook and eye, buttons, zippers or any other fastener known in the art. By fastening the flaps, the drum cover 80 is further secured to the drum set. In addition, by fastening the fasteners 106, the drum cover 80 more completely covers the drum set, further reducing the amount of the instrument which is exposed to inclement weather.

In addition, the lower circular periphery 92 contains a hemmed portion 108. A drawstring 110 is threaded through the hemmed portion 108. When the drawstring 110 is tightened, the lower circular periphery 92 is tightened under the bottom of the drum shells of the drum set. By tightening the drum shell cover 86 underneath the drum shells of the drum set, the cover is further secured to the drum set. As in the case of previously mentioned drawstring 38, drawstring 110 can be comprised of an elastic material.

Harness attachment openings 112 are provided so that harness attachments may be quickly accessed. Because different drum sets have different numbers of harness attachments, the number of openings 112 can vary. By providing openings 112, the drum set can be quickly attached and removed from the harness without having to remove the drum cover 80.

Figure 4:
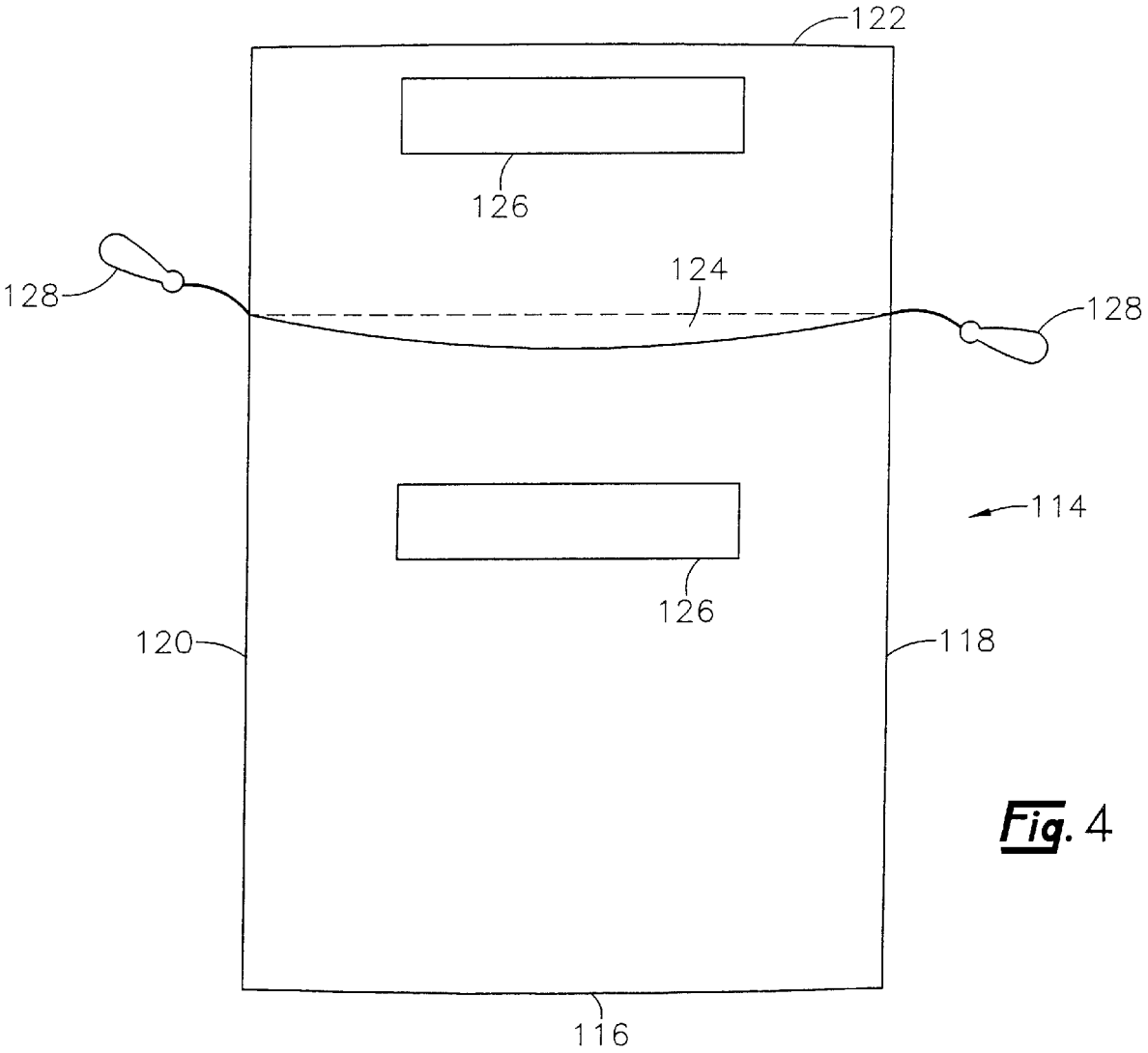
FIG. 4 is a perspective view of a drum cover carrying case.

Referring now to FIG. 4, a drum cover carrying case 114 is provided. The drum cover carrying case 114 is designed to contain the drum cover when the drum cover is not in use. The carrying case 114 reduces the risk of damage to the drum cover, when the drum cover is not is use, by removing it from exposure to sharp objects and other detrimental conditions. The carrying case is basically bag shaped. The carrying case 114 has a bottom side 116, a first side 118 and a second side 120 which are all sealed. In addition, there is a top side 122, which is open, allowing access to an inner pocket 124. The inner pocket 124 has a large enough volume to hold the drum cover. Because the drum covers can be of different sizes, the volume of the inner pocket 124 can vary. The drum cover can be conveniently folded and stored inside the inner pocket 124 when the drum cover is not in use. The carrying case 114 is made of durable, weather proof material, like the drum cover. It can be made of materials similar to the materials from which the drum covers 10, 44 and 80 are made. A bag fastener 126 is located at the top side 122 of the carrying case 114. The bag fastener 126 closes the opening in the carrying case 114, which secures the drum cover in the bag, preventing its loss and reducing the chance that the drum cover may be injured. The bag fastener 126 can be any type of conventional fastener including snaps, hoop and loop material, hook and eye, buttons, zippers or other fasteners known in the art. In addition, percussion instrument fasteners 128 are provided. The instrument fasteners 128 attach the carrying case 114 to the instrument. It is advantageous to have the carrying case 114 attached to the percussion instrument, because the drum cover will be quickly and easily accessible, should a sudden use for it arise. Also, by attaching the carrying case 114 to the drum, the drum cover is less likely to be misplaced or lost when not in use. The percussion instrument fasteners 128 may have elastic cords on the top two corners of the bag, attached to clips. These clips attach the bag to the drum.

While specific embodiments of the invention have been described with particularity above, it will be appreciated that the invention is capable of numerous rearrangements and substitutions without departing from the scope of the invention.

What is claimed is:

1. A cover for protecting a percussion instrument, the percussion instrument having an outer circumference, a striking area, a drum shell, a peripheral rim and a harness attachment, the cover comprising:

a striking surface having a substantially circular shape bounded by an outer circumference, said first striking surface being configured and dimensioned to fit over the striking area of the percussion instrument, for covering the striking area of the percussion instrument;

a drum shell cover having a substantially cylindrical shape, extending downwards from the striking surface, having an upper circular periphery and a lower circular periphery, configured to encompass and cover the drum shell of the percussion instrument;

a seam affixing the upper circular periphery of the drum shell cover to the circumference of the striking surface; and a stress resistant material, substantially annular in shape, positioned to cover an outer annular portion of the striking surface and upper cylindrical portion of the drum shell cover, for reinforcing the cover adjacent the peripheral rim of the instrument.

2. A cover for protecting a percussion instrument, the percussion instrument having an outer circumference, a striking area, a drum shell, a peripheral rim and a harness attachment, the cover comprising:

a striking surface having a substantially circular shape bounded by an outer circumference, the striking surface being configured and dimensioned to fit over the striking area of the percussion instrument, for covering the striking area of the percussion instrument;

a drum shell cover having a substantially cylindrical shape, extending downwards from the striking surface, having an upper circular periphery and a lower circular periphery, configured to encompass and cover the drum shell of the percussion instrument;

a first seam affixing the upper circular periphery of the drum shell cover to the circumference of the striking surface;

first and second flaps, each having edges, formed in the drum shell cover by a slit extending from the lower circular periphery generally toward the upper circular periphery, to provide an opening for inserting and removing the percussion instrument from the cover; and an opening in the drum shell cover for providing access to the harness attachment.

3. A cover for protecting a percussion instrument, the percussion instrument having an outer circumference, a striking area, a drum shell, a peripheral rim and a harness attachment, the cover comprising:

a striking surface having a substantially circular shape bounded by an outer circumference, the striking surface being configured and dimensioned to fit over the striking area of the percussion instrument, for covering the striking area of the percussion instrument;

a drum shell cover having a substantially cylindrical shape, extending downwards from the striking surface, having an upper circular periphery and a lower circular periphery, configured to encompass and cover the drum shell of the percussion instrument;

a first seam affixing the upper circular periphery of the drum shell cover to the circumference of the striking surface;

first and second flaps, each having edges, formed in the drum shell cover by a slit extending from the lower circular periphery generally toward the upper circular periphery, to provide an opening for inserting and removing the percussion instrument from the cover; and a hemmed portion in the lower circular periphery of the drum shell cover, the hemmed portion having a drawstring threaded therethrough and exiting the hemmed portion at the edges of the first and second flaps, for securing the cover to the percussion instrument by tightening the drawstring.

4. The cover of claim 3 wherein the drawstring is comprised of an elastic material.

5. A cover for protecting a percussion instrument, the percussion instrument having an outer circumference, a striking area, a drum shell, a peripheral rim and a harness attachment, the cover comprising:

a striking surface having a substantially circular shape bounded by an outer circumference, the striking surface being configured and dimensioned to fit over the striking area of the percussion instrument, for covering the striking area of the percussion instrument;

a drum shell cover having a substantially cylindrical shape, extending downwards from the striking surface, having an upper circular periphery and a lower circular periphery, configured to encompass and cover the drum shell of the percussion instrument;

a first seam affixing the upper circular periphery of the drum shell cover to the circumference of the striking surface;

first and second flaps, each having edges, formed in the drum shell cover by a slit extending from the lower circular periphery generally toward the upper circular periphery, to provide an opening for inserting and removing the percussion instrument from the cover; and a stress resistant material, substantially annular in shape, positioned to cover an outer annular portion of the striking surface and upper cylindrical portion of the drum shell cover, for reinforcing the cover adjacent the peripheral rim of the instrument.

6. A cover for protecting a percussion instrument, the percussion instrument having an outer circumference, two striking areas, at least one drum shell, first and second peripheral rims adjacent the two striking areas, and at least one harness attachment, the cover comprising:

a first and a second striking surface, each having a substantially circular dimension bounded by an outer circumference, said first and second striking surfaces being configured and dimensioned to fit over the first and second striking areas, respectively, of the percussion instrument, for covering the first and second striking areas of the percussion instrument;

a drum shell cover having a substantially cylindrical shape, having a first circular periphery and a second circular periphery, configured to encompass and cover the drum shell of a percussion instrument;

a first seam affixing the first string surface to the first circular periphery of the drum shell cover;

a second seam affixing the second striking surface to the second circular periphery of the drum shell cover; and an opening for providing access to the harness attachment.

7. A cover for protecting a percussion instrument, the percussion instrument having an outer circumference, two striking areas, at least one drum shell, first and second peripheral rims adjacent the two striking areas, and at least one harness attachment, the cover comprising:

a first and a second striking surface, each having a substantially circular dimension bounded by an outer circumference, said first and second striking surfaces being configured and dimensioned to fit over the first and second striking areas, respectively, of the percussion instrument, for covering the first and second striking areas of the percussion instrument;

a drum shell cover having a substantially cylindrical shape, having a first circular periphery and a second circular periphery, configured to encompass and cover the drum shell of a percussion instrument;

a first seam affixing the first striking surface to the first circular periphery of the drum shell cover;

a second seam affixing the second striking surface to the second circular periphery of the drum shell cover;

a first stress resistant material, substantially annular in shape, positioned to cover an outer annular portion of the first striking surface and the first circular periphery for reinforcing the cover adjacent a first peripheral rim; and a second stress resistant material, substantially annular in shape, positioned to cover an outer annular portion of the second striking surface and second circular periphery for reinforcing the cover adjacent the second peripheral rim.

8. A cover for protecting a percussion instrument, the percussion instrument having an outer circumference, at least one striking area, at least one drum shell, at least one peripheral rim and at least one harness attachment, the cover comprising:

a striking surface having a substantially circular shape bounded by an outer circumference, the striking surface being configured and dimensioned to fit over a plurality of striking areas of the percussion instrument, for covering the plurality of striking areas of the percussion instrument;

a drum shell cover having a substantially cylindrical shape, extending downwards from the striking surface, having an upper circular periphery and a lower circular periphery, configured to encompass and cover the plurality of drum shells of a percussion instrument;

a seam affixing the upper circular periphery of the drum shell cover to the circumference of the striking surface;

first and second flaps, each having edges, formed in the drum shell cover by a silt extending from the lower circular periphery generally toward the upper circular periphery, to provide an opening for inserting and removing the percussion instrument from the cover; and a hemmed portion provided in the lower circular periphery of the drum shell cover, the hemmed portion having a drawstring threaded therethrough and exiting the hemmed portion at the edges of the first and second flaps, for securing the cover to the percussion instrument by tightening the drawstring.

9. The cover of claim wherein the drawstring is comprised of an elastic material.

10. A cover for protecting a percussion instrument, the percussion instrument having an outer circumference, at least one striking area, at least one drum shell, at least one peripheral rim and at least one harness attachment, the cover comprising:

a striking surface having a substantially circular shape bounded by an outer circumference, the striking surface being configured and dimensioned to fit over a plurality of striking areas of the percussion instrument, for covering the plurality of striking areas of the percussion instrument;

a drum shell cover having a substantially cylindrical shape, extending downwards from the striking surface, having an upper circular periphery and a lower circular periphery, configured to encompass and cover the plurality of drum shells of a percussion instrument;

a seam affixing the upper circular periphery of the drum shell cover to the circumference of the striking surface;

first and second flaps, each having edges, formed in the drum shell cover by a slit extending from the lower circular periphery generally toward the upper circular periphery, to provide an opening for inserting and removing the percussion instrument from the cover; and at least one opening in the cover for providing access to at least one harness attachment.

* * * * *

UNITED STATES PATENT AND TRADEMARK OFFICE
CERTIFICATE OF CORRECTION

Patent No : 6,025,549

Dated : February 15, 2000

Inventor(s) : J. Vincent HARRIS

It is certified that error appears in the above-identified patent and that said Letters Patent is hereby corrected as shown below:

Column 10, line 29 change "string" to --striking--.

Column 11, line 30 change "The cover of claim" to --the cover of claim 8--.

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*